US011473522B2

(12) United States Patent
Shaer

(10) Patent No.: US 11,473,522 B2
(45) Date of Patent: Oct. 18, 2022

(54) PISTON OF AN INTERNAL COMBUSTION ENGINE

(71) Applicant: MAN Energy Solutions SE, Augsburg (DE)

(72) Inventor: Talat Shaer, Augsburg (DE)

(73) Assignee: MAN ENERGY SOLUTIONS SE, Augsburg (DE)

( * ) Notice: Subject to any disclaimer, the term of this patent is extended or adjusted under 35 U.S.C. 154(b) by 0 days.

(21) Appl. No.: 17/003,085

(22) Filed: Aug. 26, 2020

(65) Prior Publication Data

US 2021/0062754 A1 Mar. 4, 2021

(30) Foreign Application Priority Data

Aug. 27, 2019 (DE) ..... 10 2019 122 877.8

(51) Int. Cl.
*F02F 3/22* (2006.01)
*F02F 3/00* (2006.01)
(Continued)

(52) U.S. Cl.
CPC ..... *F02F 3/22* (2013.01); *F01M 1/06* (2013.01); *F01P 3/10* (2013.01); *F02F 3/0015* (2013.01); *F01M 2001/066* (2013.01)

(58) Field of Classification Search
CPC .... F02F 3/22; F02F 3/0015; F02F 3/20; F02F 3/16; F01P 3/10; F01P 3/06; F01M 1/06; F01M 2001/066; F16J 1/005; F16J 1/08
See application file for complete search history.

(56) References Cited

U.S. PATENT DOCUMENTS 1,953,109 A * 4/1934 Heron ..... F02F 3/18 123/41.16
2,266,192 A * 12/1941 Grieshaber ..... F16C 5/00 92/157

(Continued)

FOREIGN PATENT DOCUMENTS

CN 205013072 U 2/2016
DE 1204885 11/1965

(Continued)

OTHER PUBLICATIONS

Machine translation, Detailed Description, DE102013002232A1, Pelzel et al., published Aug. 14, 2014, obtained from https://worldwide.espacenet.com/, pp. 1-8. (Year: 2014).*

(Continued)

*Primary Examiner* — Grant Moubry
(74) *Attorney, Agent, or Firm* — Cozen O'Connor

(57) ABSTRACT

An engine piston having a piston upper part, a piston lower part connected to the piston upper part, a piston pin mounted in the piston lower part connects the piston to a connecting rod, and a first cooling space between the piston upper and lower parts for cooling oil. The first cooling space is connected to a second cooling space formed between the piston upper part and a piston lower part via at least one transfer bore, a cooling oil conduction sleeve for conducting cooling oil through a bore in the connecting rod towards the first cooling space. A guiding surface of the cooling oil conduction sleeve adjoins a support face of the piston lower part. At least one groove circulating in the circumferential direction is introduced into the guiding surface of the cooling oil conduction sleeve and/or into the support face of the piston lower part.

15 Claims, 2 Drawing Sheets

(51) Int. Cl.
*F01P 3/10* (2006.01)
*F01M 1/06* (2006.01)

(56) References Cited

U.S. PATENT DOCUMENTS 2,409,057 A * 10/1946 Meinke ..... F16J 1/16
92/140
5,179,916 A * 1/1993 Schonfeld ..... F02B 75/044
123/193.6
5,413,074 A * 5/1995 Horiuchi ..... F02F 3/0015
123/193.6
5,794,582 A * 8/1998 Horiuchi ..... F16J 1/22
123/193.6
6,209,510 B1 * 4/2001 Brogdon ..... F02B 75/246
123/197.2

FOREIGN PATENT DOCUMENTS

DE 3518721 11/1986
DE 102012207951 11/2013
DE 102013002232 8/2014

OTHER PUBLICATIONS

Office Action for corresponding German Patent Application No. 10 2019 122 877.8.
Search Report dated Jan. 13, 2021 issued in European Patent Application No. 20189789.9.

* cited by examiner

PISTON OF AN INTERNAL COMBUSTION ENGINE

BACKGROUND OF INVENTION

1. Field of the Invention

The invention relates to a piston of an internal combustion engine.

2. Description of Related Art

From DE 35 18 721 C2 a piston of an internal combustion engine is known, which comprises a piston upper part and a piston lower part, which are preferentially screwed to one another. In the piston lower part, a piston pin is mounted, wherein the piston pin serves for connecting the piston to a connecting rod of the internal combustion engine. The piston according to DE 35 18 721 C2 is oil-cooled, wherein between the piston upper part and the piston lower part there is a first inner cooling space for cooling oil and a second, outer cooling space for cooling oil is formed, and wherein the inner cooling space is connected to the outer cooling space via at least one transfer bore. In order to introduce cooling oil into the inner cooling space, a feeding bore for cooling oil is integrated in the connecting rod according to this prior art, wherein the cooling oil, emanating from the connecting rod, is transferrable into the inner cooling space with the help of a multi-part cooling oil conduction sleeve. According to DE 35 18 721 C2, a first, neck-like part of the cooling oil conduction sleeve is non-moveably fastened in the piston lower part of the piston. A funnel-like moveable part of the cooling oil conduction sleeve interacts with this fixed, neck-like part of the cooling oil conduction sleeve in such a manner that a spring element, which acts between the two parts of the cooling oil conduction sleeve, resiliently presses the funnel-like part of the same in sliding contact against a small end of the connecting rod. The use of such spring-loaded cooling oil conduction sleeves for transferring the cooling oil, emanating from the bore in the connecting rod, into the inner cooling space is a disadvantage since the assembly of such cooling oil conduction sleeves involves major expenditure. Furthermore, the separate spring elements cause high friction forces between the cooling oil conduction sleeve and the connecting rod. From DE 10 2013 002 232 A1, a piston of an internal combustion engine is known, in which the cooling oil conduction sleeve is formed as a slit sleeve, which, with a guiding surface, spring-elastically presses against a support face of the piston lower part. According to this prior art, the cooling oil conduction sleeve of the piston designed as a slit sleeve is formed in one part and spring-elastically presses against the piston lower part so that a separate spring element is not needed.

SUMMARY OF THE INVENTION

There is a need to further improve the functionality of a cooled piston of an internal combustion engine.

Starting out from this, one aspect of the present invention is creating a new type of piston of an internal combustion engine.

According to a first aspect of the invention, a piston comprises at least one groove circulating in the circumferential direction that is introduced into a guiding surface of the cooling oil guiding sleeve and/or into a support face of the piston lower part.

According to one aspect of the invention, a piston comprises at least one oil pocket delimited in the circumferential direction that is introduced into the guiding surface of the cooling oil conduction sleeve and/or into the support face of the piston lower part.

According to one aspect of the invention, it is possible to introduce oil for the lubrication in a defined manner in a region between the guiding surface of the cooling oil conduction sleeve and the support face of the piston lower part. By way of this, friction and a friction-induced wear of the piston lower part and cooling oil conduction sleeve is reduced or even completely avoided. This improves the functionality of the cooled piston.

According to an advantageous further development of aspects of the invention, at least one recess, preferentially at least two recesses, which extends in the radial direction and penetrates the cooling oil conduction sleeve, via which lubricating oil can be fed to a region between the cooling oil conduction sleeve and the piston lower part. This allows a particularly advantageous supply of the groove circulating in the circumferential direction and/or of the oil pocket delimited in the circumferential direction, with lubricating oil.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

The invention present here relates to an oil-cooled piston of an internal combustion engine, in particular of an internal combustion engine embodied as diesel engine or gas engine or diesel-gas engine, such as for example a diesel internal combustion engine of a ship. Such a piston is also referred to as trunk piston.

Figure 1:
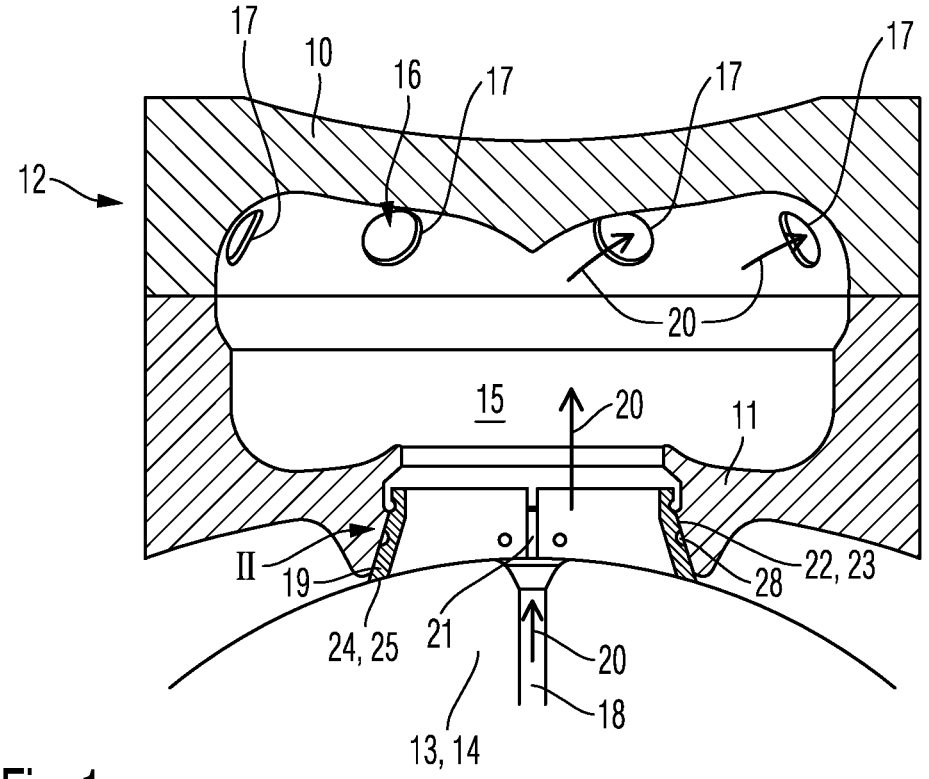
FIG. 1: is a cross section in the form of an extract through a piston in a region of a cooling oil conduction sleeve.
Figure 2:
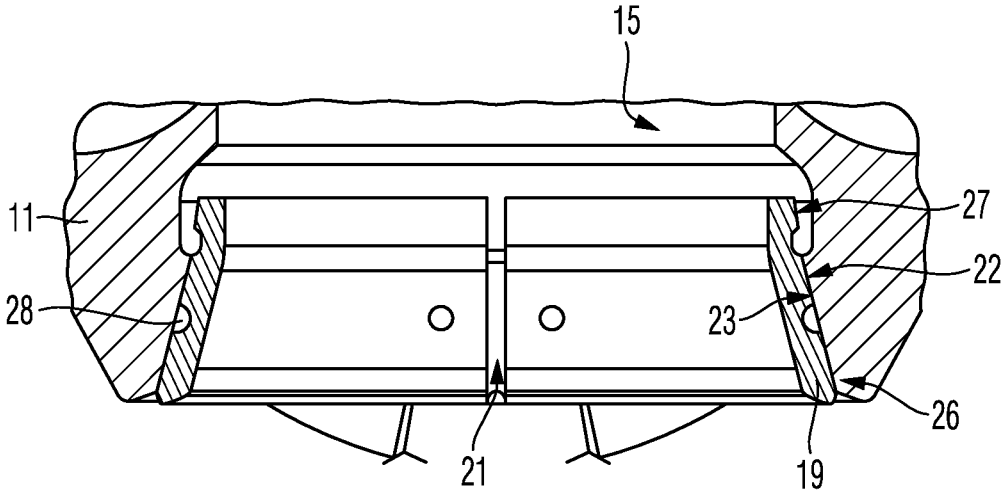
FIG. 2: the detail II of FIG. 1 in the region of the cooling oil conduction sleeve.

FIGS. 1 and 2 each show cross sections through a first piston 12 of an internal combustion engine according to one aspect of the invention in different section directions, wherein the piston 12 comprises a piston upper part 10 and a piston lower part 11. The piston upper part 10 and the piston lower part 11 are preferentially manufactured from a light metal, steel, or spheroidal graphite cast iron. The piston upper part 10 and the piston lower part 11 support themselves on one another and are connected to one another preferentially via fasteners embodied as tensile screws.

In a bore of the piston lower part 11, a piston pin is mounted, wherein the piston pin serves for connecting the piston to a connecting rod 13 of the internal combustion engine. Of the connecting rod 13, a so-called small end 14 is shown in FIG. 2.

Between the piston upper part 10 and the piston lower part 11 a first, inner cooling space 15 on the one hand and a second, outer cooling space 16 on the other hand is formed for cooling oil, wherein according to FIG. 2 the inner cooling space 15 is connected to the outer cooling space 16 via transfer bores 17.

Cooling oil, which serves for cooling the piston 12, can be fed to the piston 12, namely to the first, inner cooling space 15 of the piston 12, via a bore 18, which extends through the connecting rod 13 and the small end 14. Here, a cooling oil conduction sleeve 19 interacts with the connecting rod 13 or the small end 14 of the connecting rod 13. The flow of the cooling oil is visualised by arrows 20.

The cooling oil conduction sleeve 19 is formed as slit sleeve. A slit 21 of the cooling oil conduction sleeve 19 extends in the axial direction of the piston or of the cooling oil conduction sleeve 19.

In the disassembled state, the cooling oil conduction sleeve 19 has an outer diameter, which is larger than an inner diameter of a recess in the piston lower part 11, into which the cooling oil conduction sleeve 19 is to be inserted. For inserting the cooling oil conduction sleeve 19 into this recess of the piston lower part 11, the cooling oil conduction sleeve 19 is compressed, subject to reducing a so-called mouth width of the slit 21, wherein following the insertion of the cooling oil conduction sleeve 19 into the piston lower part 11, a guiding surface 22 of the cooling oil conduction sleeve 19 spring-elastically presses against a corresponding support face 23 of the piston lower part 11.

The cooling oil conduction sleeve 19 is embodied in one piece or one part and is mounted in the piston lower part 11 without separate spring element.

Preferentially, the guiding surface 22 of the cooling oil conduction sleeve 19 and the support face 23 of the piston lower part 11, against which the first guiding surface 22 of the cooling oil conduction sleeve 19 presses spring-elastically, is contoured in the manner of a truncated cone. By way of this it is ensured that the cooling oil conduction sleeve 19, furthermore, spring-elastically presses against a support face 25 of the small end 14 of the connecting rod 13 with a further guiding surface 24.

The preferentially truncated cone-like guiding surface 22 of the cooling oil conduction sleeve 19 and the corresponding support face 23 of the piston lower part 11 taper, emanating from an end 26 of the cooling oil conduction sleeve 19 facing the connecting rod 13, seen in the axial direction of the piston or the cooling oil conduction sleeve 19, in the direction of an end 27 of the cooling oil conduction sleeve 19 facing away from the connecting rod 13.

As already explained, the cooling oil conduction sleeve 19, after the assembly of the cooling oil conduction sleeve 19 in the corresponding recess in the piston lower part 11, is spring-elastically pressed with the guiding surface 22 against the support face 23 of the piston lower part.

In particular when the connecting rod 13 is subsequently mounted, the cooling oil conduction sleeve 19 is further compressed, so that as a consequence of the truncated cone-like contouring of the guiding surface 22 and of the support face 23, the cooling oil conduction sleeve 19, with the further guiding surface 24, spring-elastically presses against the corresponding support face 25 of the small end 14 of the connecting rod 13. By way of this, a lifting of the cooling oil conduction sleeve 19 off the small end 14 of the connecting rod 13 is prevented and a good seal between the small end 14 of the connecting rod 13 and the cooling oil conduction sleeve 19 always ensured.

According to one aspect of the invention, at least one groove circulating in the circumferential direction is introduced into the guiding surface 22 of the cooling oil conduction sleeve 19 that is preferentially contoured tapering in the manner of a truncated cone and/or into the correspondingly contoured support face 23 of the piston lower part 11. FIGS. 1 and 2 show an exemplary embodiment, in which such a groove 28 is exclusively introduced into the guiding surface 22 of the cooling oil conduction sleeve 19. This groove 28 circulating in the circumferential direction can be supplied with lubricating oil in particular via the slit 21 of the slit cooling oil conduction sleeve 19, wherein the lubricating oil passes through the slit 21 and enters the groove 28 of the cooling oil conduction sleeve 19. By way of this, a contact region between the cooling oil conduction sleeve 19 and the piston lower part 11 can be lubricated in a defined manner in order to reduce friction and wear there.

Figure 3:
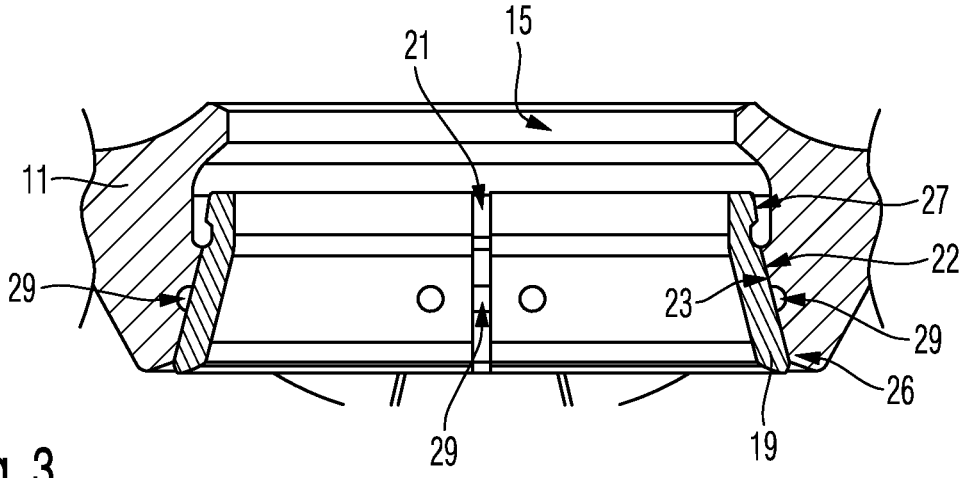
FIG. 3: is a detail of a piston in a region of the cooling oil conduction sleeve.

FIG. 3 shows a detail of a piston according to one aspect of the invention, in which a groove 29 circulating in the circumferential direction is introduced into the support face 23 of the piston lower part 11. This groove 29 can also be supplied with the lubricating oil via the slit 21.

Figure 4:
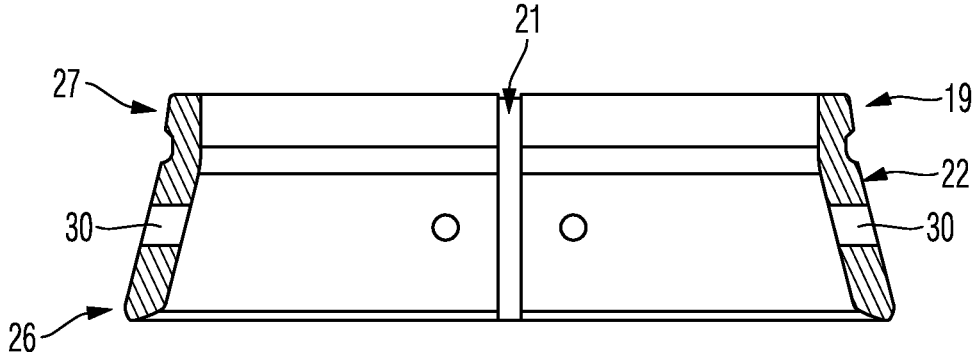
FIG. 4: is a cooling oil conduction sleeve of the piston.

In order to improve the supply of the groove 28 of the exemplary embodiment of FIG. 1, 2 or of the groove 29 of the exemplary embodiment of FIG. 3 with lubricating oil, at least one recess 30 extending in the radial direction and penetrating the cooling oil conduction sleeve 19 is introduced into the cooling oil conduction sleeve 19 in the exemplary embodiment of FIG. 4.

In FIG. 4, at least two such recesses 30 are introduced into the cooling oil conduction sleeve 19. By way of these recesses 30, the region between the cooling oil conduction sleeve 19 and the piston lower part 11 can be supplied with lubricating oil, in particular this lubricating oil can be fed to the respective groove 28, 29 via the respective recess 30.

It is pointed out here that both the groove 28 can be introduced into the cooling oil conduction sleeve 19 and also simultaneously the groove 29 into the piston lower part 11. In this case, oil can be fed to both grooves 28, 29 via the recesses 30.

Figure 5:
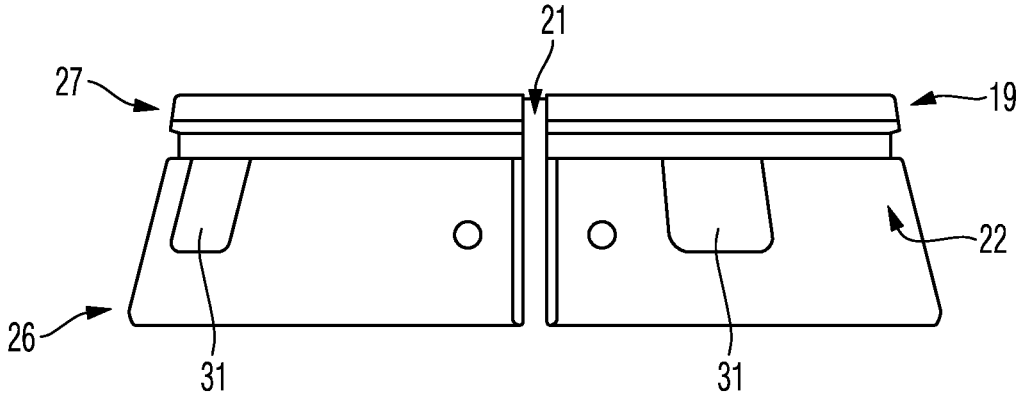
FIG. 5: is a cooling oil conduction sleeve of the piston.

According to one aspect of the invention present here it is provided that the guiding surface 22 of the cooling oil conduction sleeve 19 preferentially contoured in the manner of a truncated cone and/or into the support face 23 of the piston lower part 11, at least one oil pocket 31 delimited in the circumferential direction is introduced. FIG. 5 shows a lateral view of a cooling oil conduction sleeve 19 according to the second aspect of the invention, wherein in FIG. 5 multiple oil pockets 31 delimited in the circumferential direction are introduced into the guiding surface 22 of the cooling oil conduction sleeve 19.

Oil pockets 31 are delimited in the circumferential direction in such a manner can be additionally or alternatively introduced also into the support face 23 of the piston lower part 11.

Furthermore it is possible to combine the aspects of the invention with one another, i.e. utilise both a groove 28 and/or 29 circulating in the circumferential direction combined with the oil pockets 31. Any combinations are conceivable here.

Accordingly, a circumferential groove 28 can be introduced into the guiding surface 22 of the cooling oil conduction sleeve 19 and multiple oil pockets can be introduced into the support face 23 of the piston lower part 11. It is also possible to introduce multiple oil pockets 31 delimited in the circumferential direction into the guiding surface 22 of the cooling oil conduction sleeve 19 and a circumferential groove 29 into the support face 23 of the piston lower part 11.

Furthermore it is also possible in FIG. 5 that, in turn, at least one, preferentially at least two recesses 30 extending in the radial direction and penetrating the cooling oil conduction sleeve 19 is or are introduced into the cooling oil conduction sleeve 19, via which lubricating oil can be fed to a region between the cooling oil conduction sleeve 19 and the piston lower part 11, in particular in such a manner, that the lubricating oil can be fed to the respective oil pocket 31 via the respective recess 30.

With the invention it is possible to supply a contact region between the cooling oil conduction sleeve 19 and the piston lower part 11 with lubricating oil in a defined manner in order to minimise or even completely avoid friction and wear between cooling oil conduction sleeve 19 and piston lower part 11.

The invention is employed in particular with pistons of large engines such as diesel engines or gas engines or diesel-gas engines in ship applications, the outer diameter of which is in particular in the range between 100 mm and 600 mm.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A piston of an internal combustion engine, comprising a piston upper part;

a piston lower part connected to the piston upper part;

a piston pin, which is mounted in the piston lower part and configured to connect the piston to a connecting rod of the internal combustion engine;

at least one transfer bore;

a first cooling space formed between the piston upper part and the piston lower part for cooling oil for cooling the piston;

a second cooling space, formed between the piston upper part and the piston lower part, connected to the first cooling space via the at least one transfer bore;

a cooling oil conduction sleeve arranged only in the piston lower part, configured to conduct cooling oil, conducted through a bore in the connecting rod, towards the first cooling space, wherein a guiding surface of the cooling oil conduction sleeve adjoins a support face of the piston lower part; and at least one groove circulating in a circumferential direction introduced into the guiding surface of the cooling oil conduction sleeve.

2. The piston according to claim 1, wherein the cooling oil conduction sleeve is formed as slit sleeve with a slit extending in an axial direction, which with the guiding surface spring-elastically presses against the support face of the piston lower part, and wherein lubricating oil, via the slit, enters the respective groove of the cooling oil conduction sleeve and/or of the piston lower part.

3. The piston according to claim 1, further comprising:

at least one oil pocket delimited in a circumferential direction is introduced into the guiding surface of the cooling oil conduction sleeve and/or into the support face of the piston lower part.

4. The piston according to claim 1, further comprising:

at least one oil pocket delimited in a circumferential direction is introduced into the guiding surface of the cooling oil conduction sleeve and/or into the support face of the piston lower part.

5. The piston according to claim 4, wherein the cooling oil conduction sleeve is formed as slit sleeve with a slit extending in an axial direction, which with the guiding surface spring-elastically presses against the support face of the piston lower part.

6. The piston according to claim 4, further comprising:

at least one recess, which extends in a radial direction and penetrates the cooling oil conduction sleeve, introduced into the cooling oil conduction sleeve and configured to feed lubricating oil to a region between the cooling oil conduction sleeve and the piston lower part.

7. The piston according to claim 4, further comprising:

at least two recesses, which extend in a radial direction and penetrate the cooling oil conduction sleeve introduced into the cooling oil conduction sleeve and configured to feed lubricating oil to a region between the cooling oil conduction sleeve and the piston lower part.

8. The piston according to claim 7, wherein lubricating oil is fed to a respective oil pocket of the cooling oil conduction sleeve and/or of the piston lower part via a respective recess.

9. The piston according to claim 1, further comprising:

at least one recess, which extends in a radial direction and penetrates the cooling oil conduction sleeve, introduced into the cooling oil conduction sleeve and configured to feed lubricating oil to a region between the cooling oil conduction sleeve and the piston lower part.

10. The piston according to claim 1, wherein the at least one groove circulating in the circumferential direction is introduced into the guiding surface of the cooling oil conduction sleeve and into the support face of the piston lower part.

11. The piston according to claim 1, wherein the at least one groove circulating in the circumferential direction is introduced into the support face of the piston lower part.

12. The piston according to claim 1, wherein the first cooling space and the second cooling space are each open uninterrupted spaces.

13. The piston according to claim 1, further comprising at least one groove circulating in a circumferential direction introduced into the support face of the piston lower part.

14. A piston of an internal combustion engine, comprising:

a piston upper part;

a piston lower part connected to the piston upper part;

a piston pin, which is mounted in the piston lower part and configured to connect the piston to a connecting rod of the internal combustion engine;

at least one transfer bore a first cooling space formed between the piston upper part and the piston lower part for cooling oil for cooling the piston;

a second cooling space, formed between the piston upper part and the piston lower part, connected to the first cooling space via the at least one transfer bore;

a cooling oil conduction sleeve, configured to conduct cooling oil, conducted through a bore in the connecting rod, towards the first cooling space, wherein a guiding surface of the cooling oil conduction sleeve adjoins a support face of the piston lower part; and at least one groove circulating in a circumferential direction introduced into the guiding surface of the cooling oil conduction sleeve and/or into the support face of the piston lower part; and at least two recesses, which extend in a radial direction and penetrate the cooling oil conduction sleeve, introduced into the cooling oil conduction sleeve and configured to feed lubricating oil to a region between the cooling oil conduction sleeve and the piston lower part.

15. The piston according to claim 14, wherein, the lubricating oil can be fed to a respective groove of the cooling oil conduction sleeve and/or of the piston lower part via a respective recess.

* * * * *